United States Patent [19]

Clanton et al.

[11] 4,422,131

[45] Dec. 20, 1983

[54] FINGER LIGHT

[75] Inventors: Richard A. Clanton, Seminole; Raymond W. Simmons, Pinellas Park, both of Fla.

[73] Assignee: Concept P.R. Inc., Clearwater, Fla.

[21] Appl. No.: 415,324

[22] Filed: Sep. 7, 1982

[51] Int. Cl.[3] ..... F21L 7/00

[52] U.S. Cl. ..... 362/186; 200/60; 362/103; 362/189; 362/190; 362/191; 362/203; 362/205

[58] Field of Search ..... 362/103, 186, 189, 190, 362/191, 203, 205; 200/60

[56] References Cited

U.S. PATENT DOCUMENTS

| | | | |
|---|---|---|---|
| 4,183,076 | 1/1980 | Bodde | 362/191 |
| 4,281,368 | 7/1981 | Humbert | 362/203 |

*Primary Examiner*—Stephen J. Lechert, Jr.
*Attorney, Agent, or Firm*—James R. Hulen

[57] ABSTRACT

A light adapted to be worn on a human finger has a substantially hollow housing having the general configuration of a finger with an opening therein into which a human finger may be positioned. A pressure-activated light source in the form of a bulb, a battery and a spring for maintaining the bulb and battery spaced from one another is positioned in a closed end of the housing and adapted to be activated when a finger inserted into the housing forces the battery against the contact of the bulb.

4 Claims, 10 Drawing Figures

FIG. 1
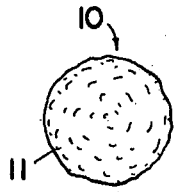
FIG. 2
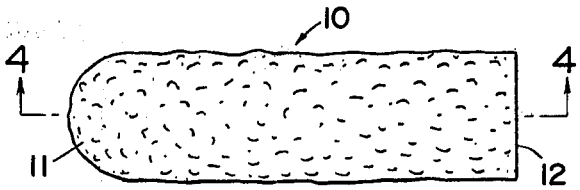
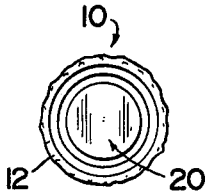
FIG. 3
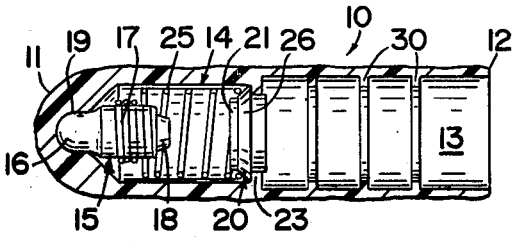
FIG. 4
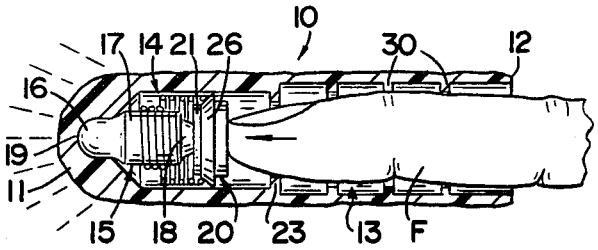
FIG. 5
FIG. 6
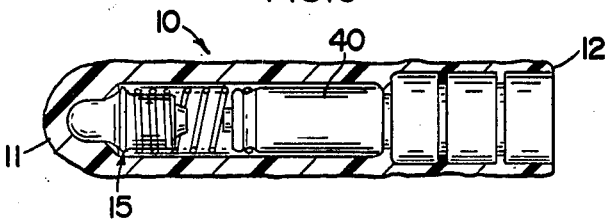
FIG. 7
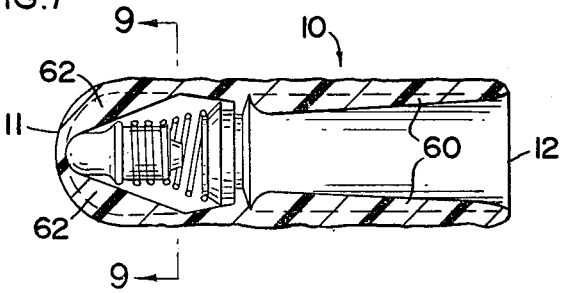
FIG. 8
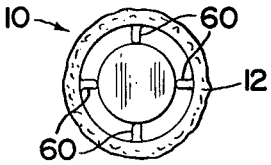
FIG. 9
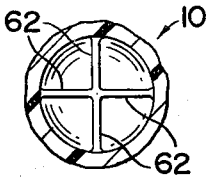
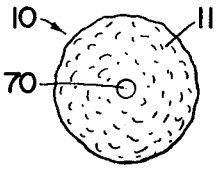
FIG. 10

FINGER LIGHT

This invention relates to lights and, more particularly, to a unique light that may be activated by a single human finger and that may be worn as an extension of such finger.

Heretofore, lights that glow in the dark or provide a directed beam have been constructed and adapted to be held in the hand of a user or supported on some object.

The present invention provides a unique light structure that is generally in the configuration of a human finger and is adapted to be worn as an extension of the human finger.

The primary object of the present invention is to provide a unique light mechanism that, when supported on a human finger, may be activated by forcing the finger into contact with a light source that is supported within the tip of the housing structure.

A further object is to provide a finger light mechanism that will accommodate a variety of human finger sizes and is relatively inexpensive to manufacture.

Further objects and advantages of the invention will become apparent from the following description of a preferred embodiment and the drawings, wherein:

FIG. 1 is a side view of the finger light of the present invention;

FIG. 2 is a front end view of the finger light illustrated in FIG. 1;

FIG. 3 is a rear end view of the finger light illustrated in FIG. 1;

FIG. 4 is a sectional view taken along line 4—4 in FIG. 1;

FIG. 5 is a sectional view similar to FIG. 4 illustrating the operation of the finger light;

FIG. 6 is a sectional view similar to FIG. 4 but illustrating a further embodiment of the present invention;

FIG. 7 is a sectional view similar to FIG. 4 illustrating a still further embodiment of the present invention;

FIG. 8 is a rear end view of the finger light illustrated in FIG. 7;

FIG. 9 is a sectional view taken along line 9—9 in FIG. 7; and

FIG. 10 is a front end view illustrating a further embodiment of the invention.

Referring to FIG. 1, the preferred embodiment of the invention is illustrated as an elongated housing 10 having the general configuration of a human finger. The external surface of housing 10 may be textured to simulate the texture of a finger and the housing preferably may be molded as a single unit from suitable plastic or rubber materials.

Housing 10 has a closed end 11 and an open end 12 which is adapted to receive a human finger. Referring to FIG. 4, housing 10 is illustrated as having a substantially hollow internal portion 13 into which a human finger may be positioned. A light source shown generally at 14 in FIG. 4 is positioned adjacent closed end 11 of housing 10 and is adapted to be activated by pressure from the finger of a user. Light source 14 may include a light bulb 15 having a glass dome 16, a metal base 17 and a contact 18. Preferably, glass dome 16 may be positioned immediately adjacent closed end 11 and contact 18 may be positioned to face toward open end 12 of housing 10. An indentation 19 may be formed into the inner surface of closed end 11 to provide a means for securely positioning glass dome 16.

A battery 20 is positioned adjacent bulb 15 and normally may be spaced from the bulb in a direction toward open end 12. Battery 20 has a terminal 21 facing in the direction of contact 18 and the battery is securely held within housing 10 by an internal flange 23, which prevents the battery from being displaced from the housing.

An electrically conductive spring 25 may be provided to bias bulb 15 and battery 20 apart and to complete the electrical circuit between the bulb and the battery when terminal 21 is forced into contact with contact 18. Preferably, spring 25 is in the form of a coiled spring and may be threaded onto metal base 17 of bulb 15 and may be in contact with the opposite terminal 26 of battery 20.

In order to accommodate a number of different size fingers within housing 10, a plurality of substantially circumferencial ribs 30 may be provided. Ribs 30 may be deformed during the insertion of a finger into housing 10 to thereby accommodate a variety of finger sizes (see FIG. 5).

During the use of the unique finger light of the present invention, a finger F may be inserted into open end 12 of housing 10, as illustrated in FIG. 5, and forced into contact with battery 20. The continued movement of finger F in the direction of the arrow in FIG. 5 overcomes the force of spring 25 and causes battery terminal 21 to come into contact with bulb contact 18. This contact completes the electrical circuit and provides power to bulb 15 and causes the light to glow. Since at least the closed end of housing 10 preferably is made from a translucent material, light from bulb 15 may be transmitted through the wall of housing 10 and thereby provide a bright, glowing light. If desired, the material from which housing 10 is fabricated, may be a transparent material and, thus, more light may be transmitted therethrough.

As an alternative procedure for activating bulb 15, the user's finger may be inserted into housing 10 only into contact with battery 20. The closed end 11 of housing 10 may then be placed into contact with a firm surface and the finger light may be pressed against such surface to cause contact 18 of bulb 15 to come into contact with terminal 21 of the battery. Thus, it should be noted that any manner of activation may be utilized to overcome the force of spring 25 to thereby complete the circuit and provide power to bulb 15.

An alternative embodiment of the finger light illustrated in FIG. 4 is shown in FIG. 6. In this embodiment, an elongated battery 40 may be substituted for the flat battery 20 used in the FIG. 4 embodiment. Battery 40 preferably may be a 1.5 volt AAA battery when utilized with a 1.5 volt bulb 15. Any suitable bulb and battery may be utilized with this invention so long as they are compatible in voltage and design. For example, battery 20 in FIG. 4 preferably may be an alkaline cell (625) which is commonly used to power a variety of battery operated devices, such as, wristwatches and flash attachments for cameras.

Referring to FIG. 7, a still further embodiment of the present invention is illustrated wherein housing 10 is provided with a plurality of substantially longitudinally extending ribs 60 which are provided to accommodate a number of different sized fingers. In addition to the longitudinal ribs, this embodiment substitutes a plurality of veins 62 in the closed end 11 of housing 10 to support and position glass dome 16 of bulb 15 (see FIG. 9).

Other than these modifications housing 10 is substantially identical to the previous embodiments.

In some instances, it has been found to be desirable to provide closed end 11 of housing 10 with an aperture 70 (see FIG. 10) which provides a direct passageway for the transmission of light through the housing. When this embodiment is utilized, it also may be desirable to use a lens end bulb to assist in the direction of the light through aperture 70.

We claim:

1. A light comprising: a flexible, molded, one-piece housing having a closed end and an open end, said housing having a translucent section at least in an area adjacent said closed end; a light source in said housing comprising a bulb, a battery and means for biasing said bulb and battery apart, said bulb having a glass dome, a metal base and a contact, said glass dome being positioned adjacent the closed end of said housing and said contact facing said open end; said battery being normally spaced from said bulb in a direction toward said open end and having a first terminal facing in the direction of said contact and an opposite terminal facing said open end, said battery being securely held within said housing by an inwardly directed flange molded integral with said housing at a location intermediate its closed and open ends; said biasing means being an electrically conductive spring which makes contact with said metal base of said bulb and with said opposite terminal of said battery to thereby complete the circuit when said first terminal touches said contact of said bulb; said housing being substantially hollow between said flange and said open end and adapted to receive a human finger so that said light may be worn as an extension of said finger and pressure of said finger through said flange against said battery may effect activation of said light source.

2. The light of claim 1, further comprising finger gripping means on the internal surface of said housing for providing a secure fit for a number of different size fingers.

3. The light of claim 2, wherein said finger gripping means is a plurality of substantially longitudinal ribs extending along the internal surface of said housing.

4. The light of claim 2, wherein said finger gripping means is a plurality of substantially circumferential ribs extending around the internal surface of said housing.

* * * * *